US009390636B2

(12) United States Patent
Siegel

(10) Patent No.: US 9,390,636 B2
(45) Date of Patent: Jul. 12, 2016

(54) ADVERTISING PANEL

(71) Applicant: Alan Siegel, Scottsdale, AZ (US)

(72) Inventor: Alan Siegel, Scottsdale, AZ (US)

( * ) Notice: Subject to any disclaimer, the term of this patent is extended or adjusted under 35 U.S.C. 154(b) by 19 days.

(21) Appl. No.: 14/516,997

(22) Filed: Oct. 17, 2014

(65) Prior Publication Data

US 2015/0033603 A1 Feb. 5, 2015

Related U.S. Application Data

(63) Continuation of application No. 13/737,588, filed on Jan. 9, 2013, now abandoned, which is a continuation-in-part of application No. 12/796,536, filed on Jun. 8, 2010, now abandoned.

(51) Int. Cl.

| | |
|---|---|
| ***G09F 21/04*** | (2006.01) |
| ***G09F 13/04*** | (2006.01) |
| ***G09F 7/00*** | (2006.01) |
| ***G09F 13/00*** | (2006.01) |
| ***G09F 13/08*** | (2006.01) |

(52) U.S. Cl.

CPC *G09F 13/04* (2013.01); *G09F 7/00* (2013.01); *G09F 13/00* (2013.01); *G09F 13/08* (2013.01); *G09F 21/04* (2013.01); *G09F 21/048* (2013.01)

(58) Field of Classification Search

USPC ..... 40/593

See application file for complete search history.

(56) References Cited

U.S. PATENT DOCUMENTS

| | | | |
|---|---|---|---|
| 393,175 | A | 11/1888 | Quarry |
| 2,142,548 | A | 1/1939 | Anderson |
| 4,202,396 | A | 5/1980 | Levy |
| 4,560,245 | A | 12/1985 | Sarver |
| 4,671,558 | A | 6/1987 | Cline |
| 4,736,980 | A | 4/1988 | Eubanks |
| 4,848,825 | A | 7/1989 | Niernberger |
| 4,923,239 | A | 5/1990 | Wischusen, III et al. |
| 4,958,879 | A | 9/1990 | Gillum |
| 5,064,239 | A | 11/1991 | Folcik |
| 5,211,404 | A | 5/1993 | Grant |
| 5,671,491 | A | 9/1997 | Ladd |
| 5,738,933 | A | 4/1998 | Koskiniemi et al. |
| 5,907,917 | A | 6/1999 | Bicker |
| 6,135,193 | A | 10/2000 | Lloyd |
| 6,276,083 | B1 | 8/2001 | Ross |
| 6,375,143 | B1 | 4/2002 | Burns |
| 6,640,477 | B1 | 11/2003 | Timpson et al. |

(Continued)

OTHER PUBLICATIONS

Coroplast Recommended Complementary Equipment and Supplies; www.coroplast.com; May 25, 2010; pp. 1-4.

(Continued)

*Primary Examiner* — Joanne Silbermann

(74) *Attorney, Agent, or Firm* — Schmeiser, Olsen & Watts LLP

(57) ABSTRACT

An advertising panel is disclosed which is a lightweight, portable, and foldable substrate which accepts and retains high quality graphics and photographic advertising images. The advertising panel can be used for providing advertising on the inner surface of the windshield of a vehicle. The advertising panel includes a substrate with an advertising image printed on the substrate and a light source. The light source illuminates the advertising panel from behind. A viewer exterior to the vehicle is able to see the advertising image at night because a portion of the light emitted from the light source is transmitted through both the advertising panel substrate and the advertising image.

14 Claims, 12 Drawing Sheets

(56) References Cited

U.S. PATENT DOCUMENTS

| | | | | |
|---|---|---|---|---|
| D515,629 | S | 2/2006 | Nudo, Jr. | |
| 7,090,557 | B1 | 8/2006 | Ainsworth, Jr. et al. | |
| 7,398,816 | B2 * | 7/2008 | Sala | A47H 23/02 160/10 |
| 7,461,886 | B1 * | 12/2008 | Wang | B60J 3/0239 296/97.1 |
| 7,823,309 | B2 | 11/2010 | Albenda | |
| 2004/0079496 | A1 | 4/2004 | Schoelles et al. | |
| 2004/0148832 | A1 * | 8/2004 | Albenda | G09F 15/0068 40/610 |
| 2009/0297874 | A1 | 12/2009 | Finn | |

OTHER PUBLICATIONS

FastSigns; www.fastsigns.com; Mar. 10, 2010; p. 1.
Nudo Aluma Corr; www.nudo.com; Mar. 10, 2010; pp. 1-2.

* cited by examiner

ADVERTISING PANEL

CROSS REFERENCE TO RELATED APPLICATIONS

This application is a continuation-in-part of U.S. patent application to Alan Siegel, entitled "Advertising Panel," Ser. No. 13/737,588 filed Jan. 9, 2013, which is a continuation-in-part of U.S. patent application to Alan Siegel, entitled "Advertising Panel," Ser. No. 12/796,536 filed Jun. 8, 2010, the disclosures of which are hereby incorporated entirely herein by reference.

BACKGROUND OF THE INVENTION

1. Technical Field

This invention relates generally to panels for displaying advertising images and more specifically to advertising panels that are for use in the front windshield of automobiles, and that are portable and foldable.

2. State of the Art

Rigidly mounted panels and billboards for displaying advertising materials are available in a variety of sizes and shapes. These signs and billboards are often mounted in a place where the advertising image can be seen by the target audience of the advertisement. Advertising panels can be placed on billboards alongside roads and on the front or sides of buildings, for example. These types of signs are not usually lightweight, temporary, or foldable, however. For lightweight signage, images can be printed on paper or fabric. Paper, however, has a limited lifetime. The paper gets undesirable folds and creases over time, and the quality of the image on the paper degrades, making the sign less useful in attracting interest and conveying an advertising message. Fabric tends to create a surface that is not flat, rendering the image less readable. There is a need for an advertising panel which is lightweight and foldable, but is rigid and accepts a high quality graphic image which can withstand the rigors of time and weather and still convey a pleasing and attractive image to consumers.

Vehicular windshield curtains have been manufactured to inhibit heat transfer to the interior of automobiles, with limited advertising on the forward facing surface. However, consumers have difficulty reading the full scope of the advertising image, due to the subject matter not having a flat appearance. In addition, the advertising is only useable during the day. If the surface is made solid and flat, storing a solid panel the width of a vehicle's interior has proven to be impractical. There are no existing devices that are useful for displaying high quality advertising against the windhshield of an automobile, while being light in weight, robust, rigid and simple to use.

Accordingly, there exists a need for an advertising panel to provide flat advertising signage that is portable, that can be used inside the front windshield of automobiles and is visible both during the day and during the night, that can be folded without breaking, that is neat and has a uniform appearance, that can be easily manufactured in full color with high quality advertising graphics including photographs, and that will accept and retain printing suitable for outdoor use.

DISCLOSURE OF THE INVENTION

This invention relates to panels for displaying advertising images, and more specifically, to advertising panels that are for use in the front windshield of automobiles, and that are portable and foldable. An advertising panel for use in a front windshield of a vehicle is disclosed that includes a substrate. The substrate is translucent and includes a top sheet, a bottom sheet, and a plurality of ribs coupling the top sheet to the bottom sheet in a spaced apart relationship. The advertising panel also includes a slit in the bottom sheet, where the slit runs from a first edge of the substrate to a second edge of the substrate, and wherein the bottom sheet is separated along the slit. The advertising panel also includes an image printed on the top sheet, where the top sheet is positioned towards the front windshield and the bottom sheet is positioned away from the front windshield.

In some embodiments, the advertising panel includes a light source, where the light source illuminates the bottom sheet. In some embodiments, the light source is coupled to the substrate. In some embodiments, the light source is coupled to a sun visor of the vehicle. In some embodiments, the advertising panel includes a fold line in the top sheet opposing the slit, wherein the substrate folds along the fold line. In some embodiments, the image printed on the substrate is translucent.

An advertising panel is disclosed which includes an image printed on a flat substrate, where the substrate is shaped to fit adjacent an interior surface of a front windshield of a vehicle. The advertising panel also includes a light source adjacent a rear surface of the substrate, wherein light from the light source is transmitted through the substrate and the image. In some embodiments, the light source is adapted to mount to a sun visor of the vehicle. In some embodiments, the light source is coupled to the substrate with a light source support rod.

A method of forming an advertising panel is disclosed. The method includes forming a translucent substrate shaped to fit adjacent an interior surface of a front windshield of a vehicle; printing an advertising image on a front surface of the substrate; and coupling a light source to the substrate, where light emitted by the light source is incident on a rear surface of the substrate. In some embodiments, the substrate includes a top sheet, a bottom sheet, and a plurality of ribs coupling the top sheet to the bottom sheet in a spaced apart relationship.

In some embodiments the method includes slicing the substrate through the bottom sheet from a first edge of the substrate to a second edge of the substrate, leaving the top sheet intact. In some embodiments, the slit is placed between two adjacent ribs. In some embodiments the method of forming an advertising panel further includes obtaining an advertising image and determining a desired position of a fold line in the top sheet relative to the image.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Figure 1:
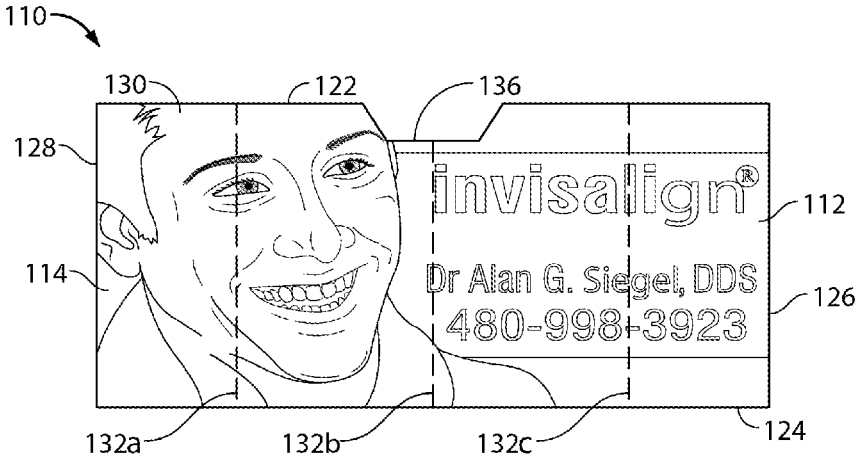
FIG. 1 is a front view of an advertising panel 110.
Figure 2:
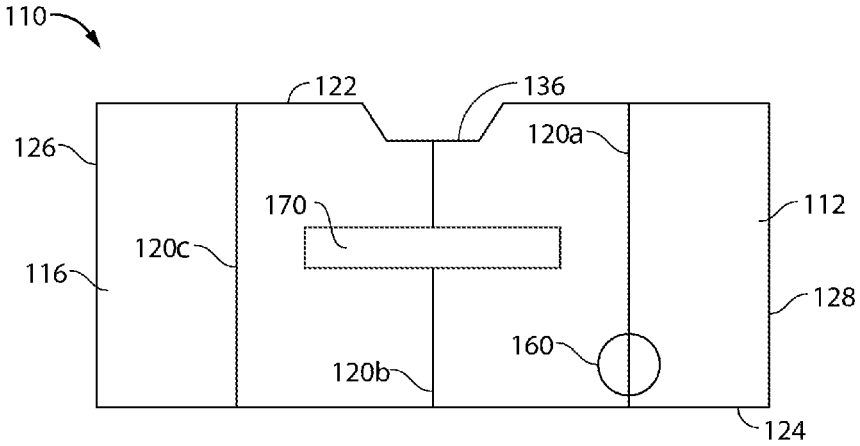
FIG. 2 is a back view of advertising panel 110 of FIG. 1.
Figure 3:
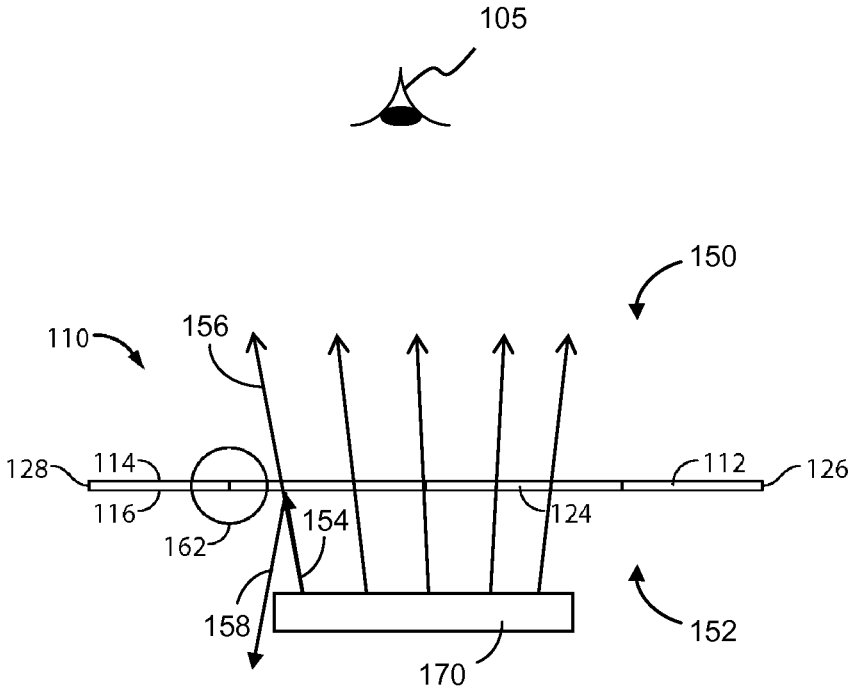
FIG. 3 is a bottom view of advertising panel 110 of FIG. 1.
Figure 4:
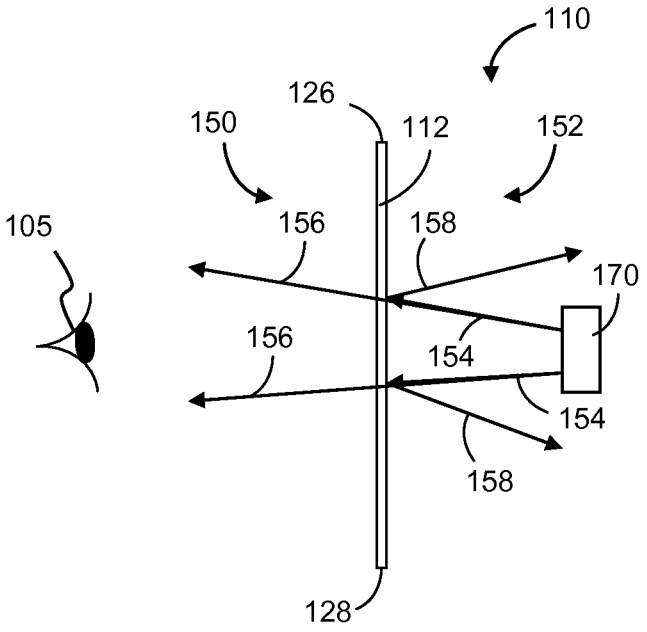
FIG. 4 is a side view of advertising panel 110 of FIG. 1.
Figure 5:
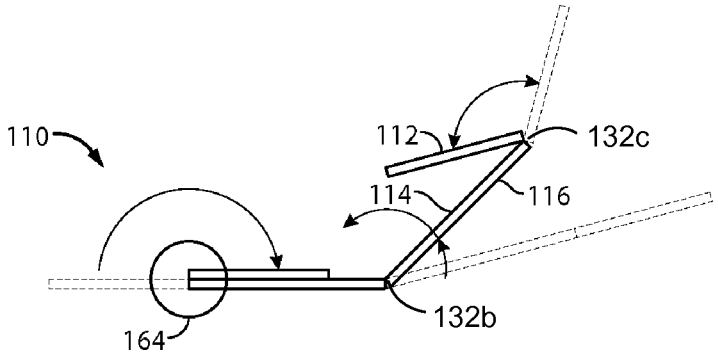
FIG. 5 is a bottom view of advertising panel 110 of FIG. 1 showing how advertising panel 110 folds.

As discussed above, embodiments of the present invention relate to portable and foldable panels for displaying an advertising image in the front windshield of a vehicle. FIG. 1 through FIG. 5 show an embodiment of an advertising panel 110 according to the invention. FIG. 1 is a front view of one embodiment of advertising panel 110. FIG. 2 is a back view of advertising panel 110 of FIG. 1, including a substrate 112 and a light source 170. FIG. 3 is a bottom view of advertising panel 110 of FIG. 1, showing substrate 112, light source 170, and a viewer 105 represented by the symbol of an eye. FIG. 4 is a side view of advertising panel 110. FIG. 5 shows a bottom view of advertising panel 110 of FIG. 1 illustrating how advertising panel 110 can be folded.

Figure 6:
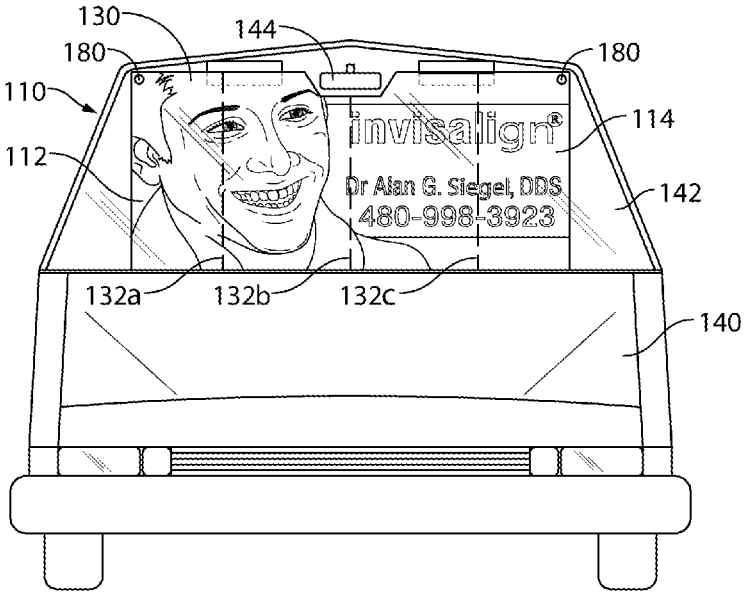
FIG. 6 is a front view of advertising panel 110 of FIG. 1 used adjacent an inner surface 166 of windshield 142 of vehicle 140.
Figure 7:
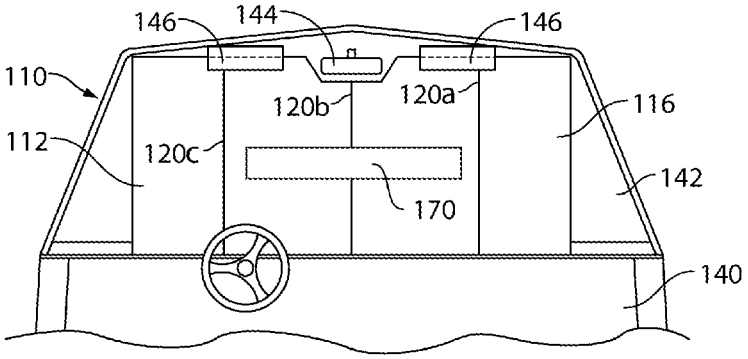
FIG. 7 is a back view of advertising panel 110 of FIG. 1 used adjacent the inner surface 166 of windshield 142 of vehicle 140.
Figure 8:
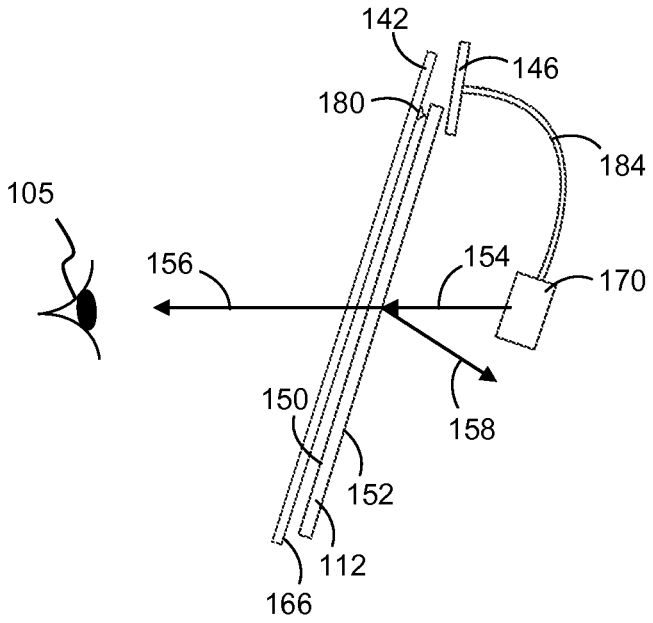
FIG. 8 is a side view of advertising panel 110 of FIG. 1 adjacent the inner surface 166 of windshield 142 of vehicle 140, where light source 170 is coupled to visor 146.
Figure 9:
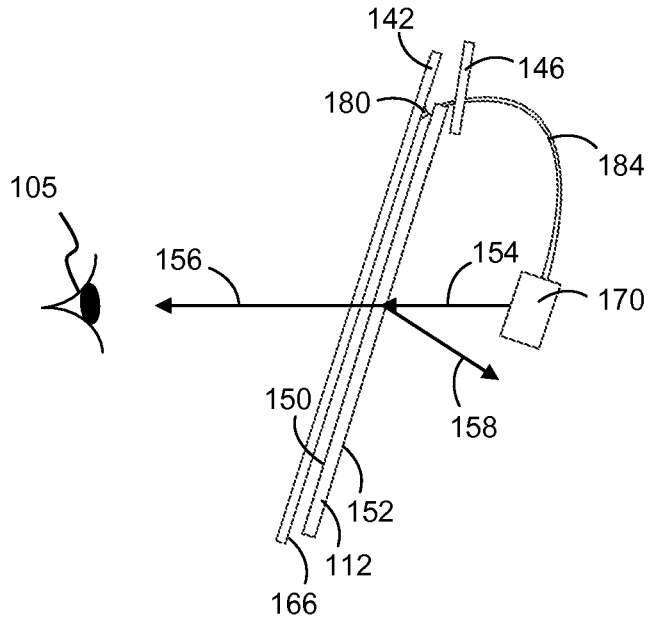
FIG. 9 is a side view of advertising panel 110 of FIG. 1 adjacent the inner surface 166 of windshield 142 of vehicle 140, where light source 170 is coupled to substrate 112.

FIG. 6 through FIG. 9 show advertising panel 110 of FIG. 1 positioned adjacent a front windshield 142 of a vehicle 140. FIG. 6 shows a front view of advertising panel 110 adjacent windshield 142. FIG. 7 shows a rear view of advertising panel 110 adjacent windshield 142. FIG. 8 shows a side view of advertising panel 110 adjacent windshield 142, with a light source 170 coupled to a sun visor 146. FIG. 9 shows a side view of advertising panel 110 adjacent windshield 142, with light source 170 coupled to a substrate 112.

Advertising panel 110 displays high quality advertising graphics on a flat substrate that is portable, foldable, and lightweight. Advertising panel 110 accepts and retains outdoor billboard quality printed images. Advertising panel 110 displays the images on a flat surface with minimal artifacts due to fold lines and no undulations or curvature in the image or the substrate. Advertising panel 110 is lightweight and can be transported easily from one display location to another. Advertising panel 110 is suited for mounting to or against the interior surface 166 of automobile windshields. Viewers exterior to the automobile are able to clearly read the advertising image of advertising panel 110. Advertising panel 110 includes a substrate 112 that is translucent and a light source 170 that emits light onto a rear surface 152 of substrate 112. That substrate 112 is translucent means that light incident on substrate 112 is partially reflected and partially transmitted. Substrate 112 is translucent so that during the day, a portion of the sunlight incident on substrate 112 is reflected from substrate 112 and the image printed on substrate 112, showing a clear, flat advertising image to the viewers of advertising panel 110. Substrate 112 is translucent so that at night, when light source 170 is emitting light, a portion of the light emitted from light source 170 is transmitted through substrate 112 and the image printed on substrate 112. Thus, at night, the viewers of advertising panel 110 can still clearly see the advertising image on substrate 112 due to light from light source 170 transmitted through substrate 112. Image 130 is also translucent, so that light is both reflected and transmitted through image 130 also.

Sun shields for use in automobiles have been disclosed, but the emphasis has been on their use as a sun block, which has made them less than optimum for use in displaying an advertising image. If an image is used on the sun shield, it is often folded or bent so that the image is not easily readable, or the image is placed on a flexible surface which distorts the image; or the image, the substrate, or both are not made from materials which retain the image color and integrity over time and exposure to the sun. Advertising panel 110 is designed specifically to accept and retain an image which has the long-term image-retention and display qualities of outdoor signage, without color washout or other degradation of image quality over time. Advertising panel 110 has the additional features of being portable, lightweight, and foldable, so advertising panel 110 can be used in places such as car windshields and inner window surfaces.

Advertising panel 110 as shown in FIG. 1 through FIG. 5 includes substrate 112 with advertising image 130 printed on substrate 112. As shown in FIG. 1 advertising image 130 advertises a business and a product (note that "Invisalign"™ is a registered trademark of Align Technologies, Inc.). Image 130 can take many different forms according to the invention. Image 130 can advertise a service, a product, a business, a person, an interest, an affiliation, or a different type of idea or entity. Image 130 in some embodiments advertises a university or a school. Image 130 in some embodiments advertises an interest such as a sport or a hobby. Image 130 in some embodiments advertises art such as photographs or paintings. Image 130 in some embodiments comprises an inspirational image, message, or icon. Image 130 can be any type of image, photo, drawing, logo, text, icon, or other graphical representation.

In this embodiment, image 130 is printed directly on substrate 112, as opposed to image 130 being printed on paper or another surface which is subsequently attached to substrate 112. Image 130 can be printed directly on substrate 112 using a printer such as a digital flat-bed printer that can handle printing substrates with rigidity and thickness. Printing image 130 directly on substrate 112 gives advertising panel longer lifetime because image 130 is not likely to peel off from substrate 112 with age or weathering. Substrate 112 has a front surface 150 and a rear surface 152. In this embodiment, front surface 150 is the outside surface of substrate 112 and image 130 is printed on front surface 150.

Advertising panel 110 according to the invention includes substrate 112. Substrate 112 is a dual-faced corrugated material in this embodiment, but this is not meant to be limiting. In this embodiment, substrate 112 includes top sheet 114, bottom sheet 116, and a plurality of ribs 118 which couple top sheet 114 to bottom sheet 116 in a spaced-apart relationship. This construction provides rigidity and strength, yet provides a lightweight panel. Substrate 112 can be formed in many different shapes according to the particular application. In some embodiments substrate 112 is not a corrugated material. In this embodiment, image 130 is printed on top sheet 114. In some embodiments, image 130 is printed on bottom sheet 116. In some embodiments, both top sheet 114 and bottom sheet 116 bear a printed image 130.

In the embodiment shown in FIG. 1 through FIG. 5, substrate 112 includes top edge 122, bottom edge 124, first side 126 and second side 128. Substrate 112 also includes front surface 150 and rear surface 152. In this embodiment substrate 112 is sized and shaped to fit adjacent the interior surface 166 of a front windshield 142 of a vehicle 140, as shown in FIG. 6, FIG. 7, FIG. 8, and FIG. 9. FIG. 6 through FIG. 9 show advertising panel 110 being used in vehicle 140 adjacent inner surface 166 of windshield 142. Front surface 150 with image 130 faces inner surface 166 of windshield 142, so that image 130 is visible from a viewer 105 that is exterior to vehicle 140. When used in this manner, advertising panel 110 displays advertising image 130 for viewing by consumers. FIG. 7 shows a rear view of advertising panel 110 in vehicle 140, showing light source 170. FIG. 8 and FIG. 9 each show side views of advertising panel 110 adjacent windshield 142. In order to be positioned adjacent inner surface 166 of windshield 142, substrate 112 includes cutout 136 (see FIG. 1) which allows placement around vehicle rearview mirror 144. In some embodiments, substrate 112 has other special shapes to fit particular vehicles or particular vehicle sizes or types.

Light source 170 allows advertising panel 110 to be visible and usable as advertisement even at night. Light source 170 is illustrated in FIG. 2, FIG. 3, and FIG. 7 through FIG. 9. Substrate 112 is translucent, thus a portion of light incident on rear surface 152 of substrate 112 transmits through substrate 112 and renders image 130 viewable in full color for viewer 105 exterior to vehicle 140. The fact that substrate 112 is translucent renders advertising panel 110 less than optimal as a sun shade because light will transmit through substrate 112. But a translucent substrate 112 improves the effectiveness of advertising panel 110 for advertising because it renders advertising panel 110 useful during the day and at night.

Light source 170 is positioned adjacent rear surface 152 (FIG. 8 and FIG. 9) such that light source 170 illuminates rear surface 152, which is bottom sheet 116 in this embodiment. Also in this embodiment, top sheet 114 bearing printed image 130 is positioned towards windshield 142 (FIG. 6). In this embodiment, bottom sheet 116 is positioned away from windshield 142 (FIG. 7). Light source 170 illuminates rear surface 152 of substrate 112, as shown in FIG. 8 and FIG. 9. Light source 170 can be mounted in vehicle 140 in many different ways. FIG. 8 shows light source 170 coupled to sun visor 146 using light source support rod 184. FIG. 9 shows light source 170 coupled to substrate 112 with light source support rod 184. In some embodiments, light source 170 is mounted in a different way to illuminate rear surface 152 of substrate 112. In this embodiment, light source 170 illuminates bottom sheet 116 (FIG. 7). Substrate 112 is coupled to inner surface 166 using couplers 180 (discussed below). Light 154 is emitted from light source 170 and incident on rear surface 152 (FIG. 3, FIG. 4, FIG. 8, and FIG. 9).

Substrate 112 is translucent, thus a portion of light 154 incident on substrate 112 is reflected, which is indicated in the figures by a reflected ray 158. A portion of light 154 incident on substrate 112 is transmitted, indicated in the figures by a transmitted ray 156. When light source 170 is used at night or in other low-light situations, a portion of light 154 incident on substrate 112 and image 130 is transmitted through substrate 112 and image 130 and is seen by viewer 105 exterior to vehicle 140. Light source 170 is often chosen to emit the complete visible spectrum, including wavelengths ranging from 400 to 700 nanometers, so that image 130 includes a complete range of colors and shades.

Substrate 112 can have any shape and any number of edges. In some embodiments, substrate 112 is cut to shape after image 130 is printed on substrate 112. In some embodiments, substrate 112 is cut to shape prior to printing.

Figure 10:
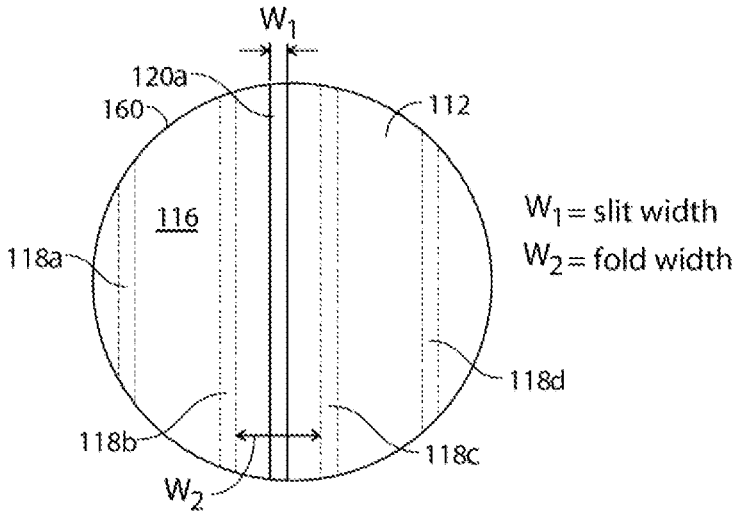
FIG. 10 is a close-up view of section 160 of FIG. 2, showing a close-up of bottom sheet 116, ribs 118, and slit 120.
Figure 11:
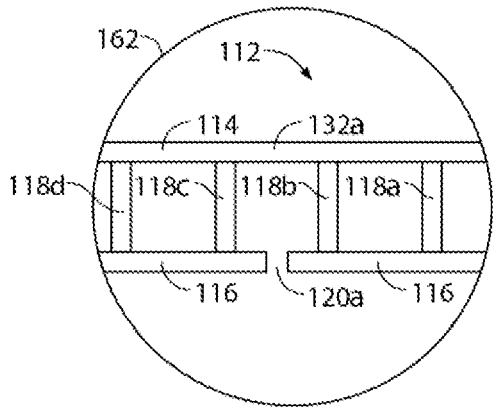
FIG. 11 is a close-up view of section 162 of FIG. 3, showing a close-up of bottom 124 including top sheet 114, bottom sheet 116, ribs 118, fold 132*a*, and slit 120*a;*
Figure 12:
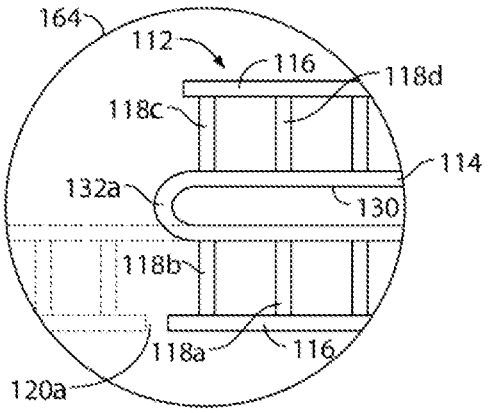
FIG. 12 is a close-up view of section 164 of FIG. 5, showing how substrate 112 folds along fold 132*a* at slit 120*a;*

Substrate 112 is formed of a dual-faced corrugated material as shown in FIG. 10, FIG. 11 and FIG. 12. FIG. 10 shows an expanded view of FIG. 2 area 160 showing a rear view of advertising panel 110 of FIG. 1. FIG. 11 is an expanded view of area 162 of FIG. 3 showing a bottom view of advertising panel 110 of FIG. 1. Ribs 118 in this embodiment run vertically from top edge 122 to bottom edge 124. Ribs 118*a*, 118*b*, 118*c*, and 118*d* are shown. This dual-faced corrugated or layered construction provides rigidity, durability, and strength to substrate 112 but still allows substrate 112 to be lightweight.

Ribs 118 according to the invention can run in many different directions. In some embodiments, ribs 118 run horizontally. In some embodiments, ribs 118 run at some other angle. Ribs 118 can run at any angle from zero to 360 degrees. In this embodiment, ribs 118 are parallel to each other and all run in the same direction. In some embodiments, ribs 118 are not parallel to each other. In some embodiments, ribs 118 run in multiple directions.

Advertising panel 110 according to the invention also includes one or more than one slit 120. Slit 120 is a separation of bottom sheet 116 which runs from a first edge of substrate 112 to a second edge of substrate 112. The embodiments shown in FIG. 1 through FIG. 12 show an advertising panel 110 with three slits 120, shown labeled as slit 120*a*, slit 120*b*, and slit 120*c*. Advertising panel 110 can have any number of slits 120. In some embodiments, advertising panel 110 has one slit 120 (see FIG. 14). In some embodiments, advertising panel 110 has more than one slit 120. The embodiment shown in FIG. 1 through FIG. 12 shows advertising panel 110 with three slits 120. Slits 120*a*, 120*b*, and 120*c* run from top edge 122 to bottom edge 124. Slit 120 according to the invention can run between any two edges of substrate 112. Bottom sheet 116 is separated along slit 120, as shown in the close-up view of slit 120*a* in FIG. 10 and FIG. 11, wherein slit 120*a* has a separation width $W_1$.

Slit 120 in bottom sheet 116 creates a corresponding fold line 132 in top sheet 114. Each slit 120 results in an opposing fold line 132 in top sheet 114. In the embodiment shown in FIG. 1 through FIG. 12, three fold lines 132*a*, 132*b*, and 132*c* are part of substrate 112. Each fold line 132 opposes a slit 120 as shown close-up by FIG. 10, FIG. 11, and FIG. 12 (showing a close-up of slit 120*a* and fold line 132*a*.)

Substrate 112 folds along fold line 132*a* as shown in FIG. 5 and FIG. 12. It is desirable to create fold line 132 with a fold area wide enough to maintain structural integrity throughout repeated folding, but not so wide as to be prominently visible or damage the overall strength of substrate 112. Slit 120*a* has a width $W_1$ as shown. Ribs 118 are spaced apart wider than slit 120, creating fold line 132*a* wider than slit 120*a*. Fold 132*a* has width $W_2$ as shown. $W_2$ is wider than slit 120*a*. In this way, substrate 112 has slit 120 with a smaller width than fold 132. Also in this way, substrate 112 has fold line 132 wider than slit 120. A fold line 132 which has a width larger than corresponding slit 120 allows advertising panel 110 to fold along fold 132 repeatably without damaging or splitting of top sheet 114 or substrate 112. In some embodiments, slit 120 and fold line 132 have the same width.

In the embodiments shown, ribs 118 run vertically and are parallel to each other. Slits 120 each run vertically between two adjacent ribs 118 in these embodiments. In the embodiment shown, slit 120*a* runs vertically from top edge 122 to bottom edge 124 between ribs 118*b* and 118*c*. Fold 132*a* is created in top sheet 114 opposite slit 120*a*. Substrate 112 folds along fold 132*a*, as shown in FIG. 9. Top sheet 114 is made of material which is strong but pliable, allowing top sheet 114 to fold along fold line 132*a*. In some embodiments, ribs 118 run at angles to top edge 122 and bottom edge 124 other than 90°. In some embodiments, slit 120 and opposing fold line 132 run at angles to top edge 122 and bottom edge 124 other than 90°.

In the embodiments shown, slit 120 runs between two adjacent ribs 118. Slit 120 in this embodiment creates a separation or gap in bottom sheet 116, but leaves ribs 118 and top sheet 114 intact. In some embodiments of advertising panel 110 according to the invention, slit 120 separates both bottom sheet 116 and ribs 118. This type of slit 120 is used where it is desirable to use a slit 120 and fold 132 which intersect at an angle with ribs 118 instead of being parallel to ribs 118. Slit 120 according to the invention can run at any angle with respect to ribs 118. In this way, slit 120 can separate bottom sheet 116 and ribs 118 while leaving top sheet 114 intact.

Advertising panel 110 according to the invention folds along fold lines 132 as shown by FIG. 5 and in close-up by FIG. 12. FIG. 5 illustrates how substrate 112 folds along fold lines 132*a*, 132*b*, and 132*c* so that substrate 112 can be folded for removal from or insertion into vehicle 140, and so that substrate 112 is portable and easily carried between locations. In this embodiment, advertising panel 110 is folded to protect image 130 on top sheet 114 during storage and transport.

Figure 13:
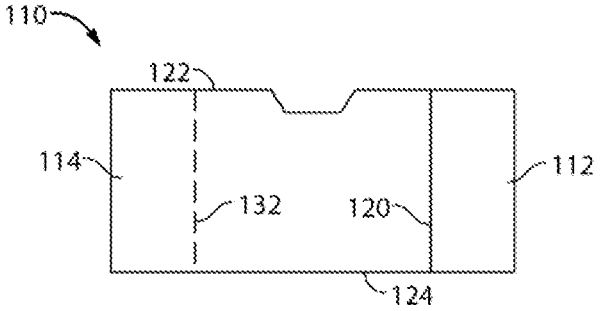
FIG. 13 is an additional embodiment of advertising panel 110.
Figure 14:
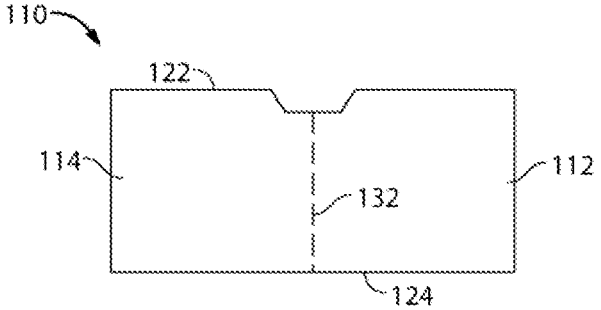
FIG. 14 is an additional embodiment of advertising panel 110.

Advertising panel 110 according to the invention can fold in many different places and in many different ways, according to the particular shape of substrate 112 and the placement of slits 120 and fold lines 132. FIG. 13 and FIG. 14 show two additional embodiments of advertising panel 110 according to the invention with different number and placement of slit 120 and fold lines 132. In the embodiment shown in FIG. 13, advertising panel 110 includes one fold line 132 in top sheet 114 opposite a corresponding slit 120 in bottom sheet 116, and one slit 120 in top sheet 114 creating an opposing fold line 132 in bottom sheet 116. FIG. 14 shows an embodiment with one slit 120 in bottom sheet 116 with an opposing one fold line 132 in top sheet 114. It is to be understood that many different numbers and placements of slits 120 and folds 132 are possible according to the invention, as well as many different sizes and shapes of substrate 112.

In some embodiments of advertising panel 110, it is desirable to place slit 120 and fold line 132 in a particular location relative to image 130. Slit 120, in such an embodiment, is placed in bottom sheet 116 opposite the desired position of fold line 132 in top sheet 114. Advertising panel 110 is designed to minimize the visibility of fold lines 120, but in some embodiments it is desirable to further minimize fold line 120 visibility by placing fold lines 120 in a particular relationship to image 130 on top sheet 114. Slit 120 is then placed in bottom sheet 116 opposite the desired predetermined placement of fold lines 120. In this way, slit 120 is placed in a predetermined position relative to image 130 on top sheet 114.

In some embodiments, an advertising image is placed on both top sheet 114 and bottom sheet 116. When an advertising image is placed on bottom sheet 116, slit 120 may be visible in the image on bottom sheet 116. In this embodiment, it is desirable to place slit 120 relative to the image on bottom sheet 116 such that slit 120 will cause minimal visible artifacts in the image. In this way, in some embodiments, slit 120 is placed in a predetermined position relative to an image on bottom sheet 116.

Substrate 112 is corrugated. Slits 120 and folds 132 enable substrate 112 to be flat when advertising panel 110 is mounted adjacent windshield 142 of vehicle 140. A flat substrate 112 allows image 130 to be clearly readable by viewer 105. With a typical sunshade, which is not flat, an advertising image is not clearly readable and is ineffective as advertisement. Advertising panel 110 is designed to create a substrate 112 that is flat when used as an advertising panel and able to be easily folded and moved.

Substrate 112 can be formed of many different materials. In some embodiments, substrate 112 is formed of corrugated cardboard or paper. In some embodiments, substrate 112 is formed of corrugated plastic. In some embodiments, substrate 112 is formed of corrugated aluminum. In some embodiments, substrate 112 is formed of a combination of materials. It is desirable for fold line 132 to exist on a material which can be folded numerous times without degradations, tearing, or creating permanent fold marks. For this reason, top sheet 114 or bottom sheet 116, whichever sheet has fold lines 132, can be made of plastic or aluminum. It is also desirable for image 130 to be printed on a surface which retains high-quality graphic inks well. For this reason, top sheet 114 or bottom sheet 116, whichever sheet has image 130 printed on it, can be made of a material designed to accept and retain outdoor advertising inks, such as a polyproplylene copolymer. In some embodiments, one or both of top sheet 114 and bottom sheet 116 are made of plastic or aluminum, and ribs 118 are made from a different material which adds strength and rigidity to substrate 112 while adding minimal weight to substrate 112.

In the embodiments shown, substrate 112 is a corrugated plastic twin-wall sheet made from polypropylene copolymer. In some embodiments, this can be a substrate such as Coroplast™ from the Coroplast company. This results in a lightweight advertising panel 110 with high strength which can accept high quality graphics with minimal degradation from time and weather.

Figure 15:
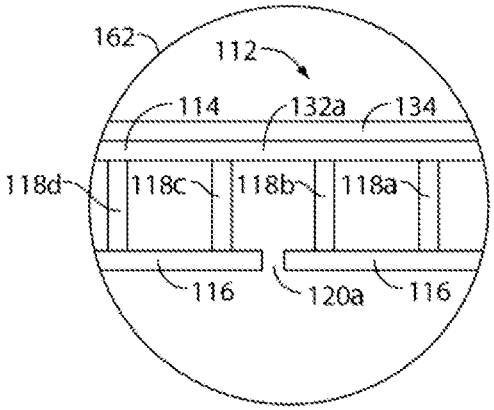
FIG. 15 is a close-up view of area 162 of FIG. 3, showing an alternate embodiment of substrate 112 including coating 134 on top sheet 114.
Figure 16:
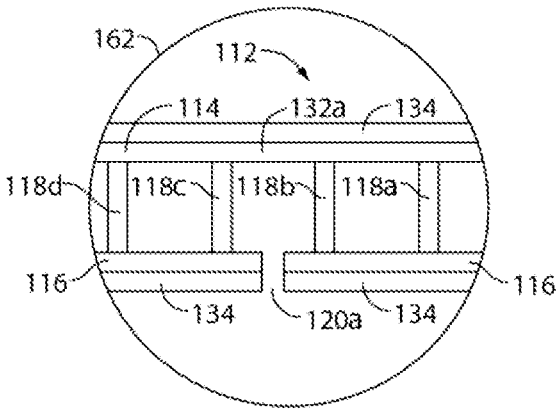
FIG. 16 is a close-up view of area 162 of FIG. 3, showing an alternate embodiment of substrate 112 including coating 134 on top sheet 114 and bottom sheet 116.

Advertising panel 110 in some embodiments uses a substrate 112 which is coated on top sheet 114, bottom sheet 116, or both top sheet 114 and bottom sheet 116. FIG. 15 and FIG. 16 show alternate close-up embodiments of substrate 112 bearing coating 134. FIG. 15 shows an embodiment of substrate 112 according to the invention with coating 134 on top sheet 114. In some embodiments, coating 134 is placed on bottom sheet 116 only. FIG. 16 shows an embodiment of substrate 112 according to the invention with coating 134 on top sheet 114 and bottom sheet 116. Coating 134 can have many different purposes. Coating 134 can be added for strength, such as a coating 134 containing fiberglass fibers, to top sheet 114 or bottom sheet 116. Coating 134, in some embodiments, is a coating which stabilizes the inks used in printing image 130. Using a coating 134 which stabilizes printing inks helps image 130 retain its color and vividness over time.

In some embodiments coating 134 is a corona treatment. A corona treatment is a way to treat the surface of any material so that it more readily accepts and retains printing inks Corona treatments use an electrode spark to penetrate the material, increasing the surface energy of the material and creating a surface more receptive to printing inks.

Advertising panel 110, in some embodiments, includes apparatus to hold advertising panel 110 in position. FIG. 6, FIG. 8 and FIG. 9 show advertising panel 110 with coupling device 180 used to couple substrate 112 to inner surface 166 of windshield 142. In this embodiment, coupling device 180 is two sets of hook and loop attachments, where each set includes one hook and loop attachment device attached to advertising panel 110, and an opposing hook and loop attachment device attached to the inner surface of windshield 142. Coupling device 180 is used to hold advertising panel 110 in the position desired for displaying advertising image 130. Coupling device 180 can take many forms. In some embodiments, coupling device 180 is a suction cup. In some embodiments, coupling device 180 is a hook and corresponding hole to accept the hook. Coupling device 180 can be snaps, ties, glue, picture mounts, adhesive tape, or any other apparatus used to hold advertising panel 110 in its position on a window, a wall, in a vehicle, or any other desired placement of advertising panel 110.

FIG. 17 through FIG. 20 show an additional embodiment of substrate 112 having at least one pivotal latch 127. The element numbers are the same as set forth in FIG. 1 through FIG. 16 unless otherwise indicated. Pivotal latch 127 is used to keep substrate 112 in the unfolded position. In the embodiment of substrate 112 shown in FIG. 17 through FIG. 20, substrate 112 includes at least one pivotal latch 127. Pivotal latch 127 extends across slit 120 to engage first pin member 133. When pivotal latch 127 is extended across slit 120 and engages first pin member 133, substrate 112 is prevented from folding along fold 132 that is opposite slit 120.

Figure 17:
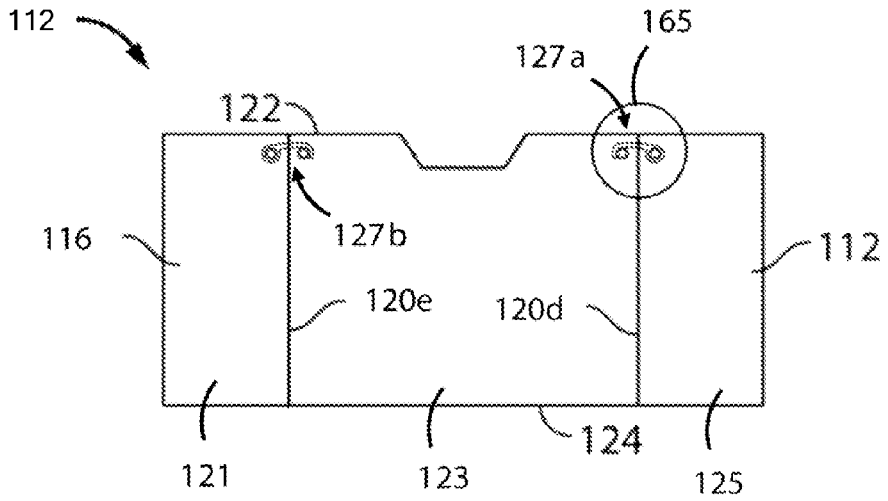
FIG. 17 is a back view of a further embodiment of substrate 112, showing a pivotal latch 127.
Figure 18:
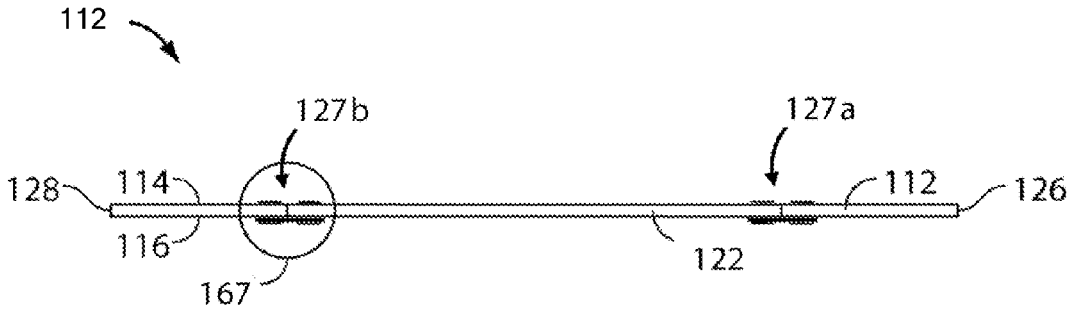
FIG. 18 is a top view of substrate 112 of FIG. 17, showing pivotal latch 127.

FIG. 17 shows an embodiment of substrate 112 where substrate 112 includes a first panel section 121, a second panel section 123, and a third panel section 125. Substrate 112, in this embodiment, includes two slits 120 shown in the drawings as slit 120*d* and slit 120*e*. Slit 120*e* divides first panel section 121 from second panel section 123. Slit 120*d* divides second panel section 123 from third panel section 125. Substrate 112 as shown in FIG. 17 and FIG. 18 includes two pivotal latches 127, shown in the drawings as pivotal latch 127*a* and 127*b*. Pivotal latches 127*a* and 127*b* extend across slits 120*d* or 120*e* respectively to engage first pin members 133.

Figure 19:
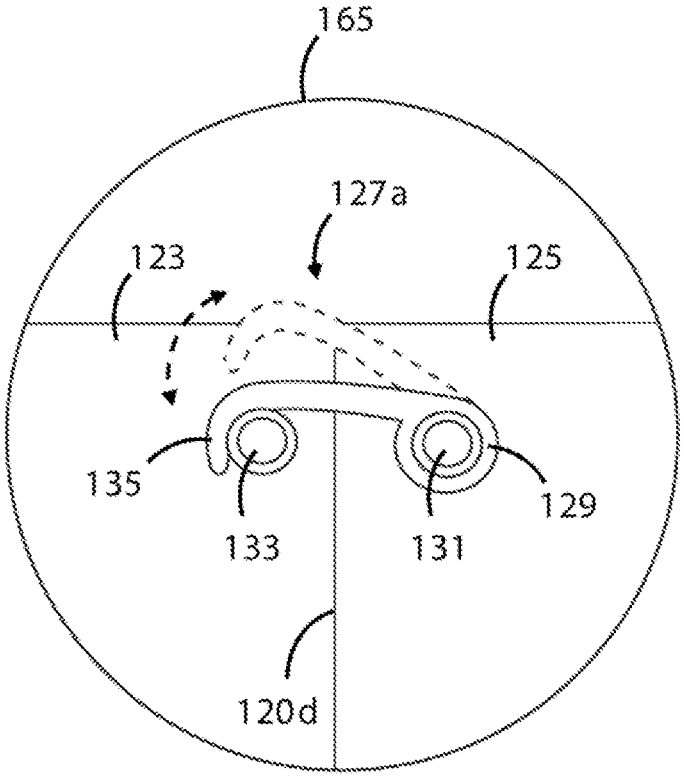
FIG. 19 is an enlarged view of section 165 of FIG. 17, showing pivotal latch 127.
Figure 20:
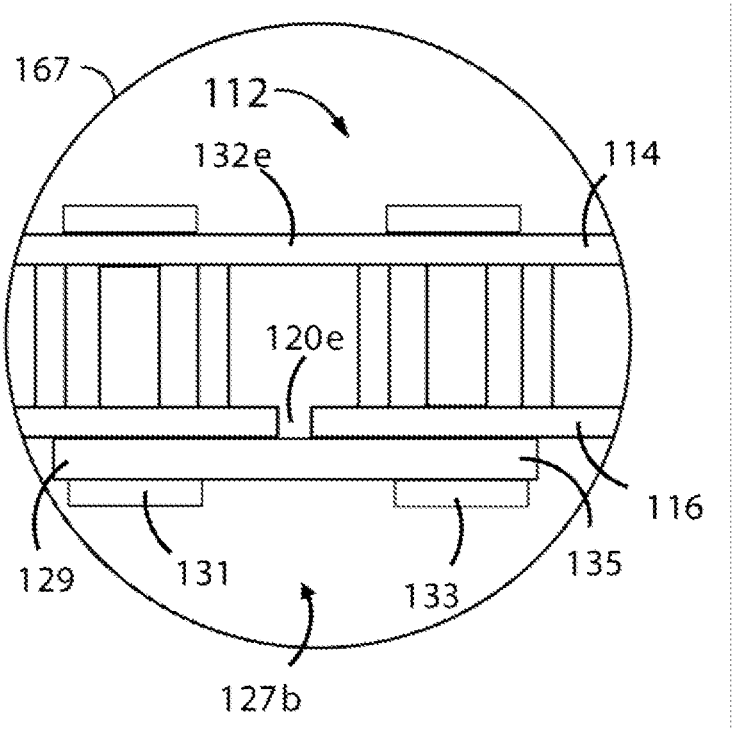
FIG. 20 is a close-up view of section 167 of FIG. 18, showing a close-up of top edge 122 including top sheet 114, bottom sheet 116 and pivotal latch 127.

FIG. 19 is an enlarged view of section 165 of FIG. 17. Section 165 is a close-up view of pivotal latch 127*a*. Pivotal latch 127*a* includes a rear flange portion 129 and a front hook portion 135. Pivotal latch 127*a* is coupled to substrate 112 at third panel section 125 using a second pin member 131. Pivotal latch 127*a* is pivotably coupled to substrate 112 at third panel section 125. First pin member 133 is mounted to substrate 112 second panel section 123. Pivotal latch 127*a* is provided with rear flange portion 129 pivotably mounted on second pin member 131 on third panel section 125 and front hook portion 135 extending from rear flange portion 129 to selectively engage first pin member 133 provided on second panel section 123 adjacent third panel section 125 on bottom sheet 116. Pivotal latch 127*a* is mounted to third panel section 125 such that pivotal latch 127*a* front hook portion 135 extends across slit 120*d* to engage first pin member 133. When pivotal latch 127*a* is pivoted such that front hook portion 135 engages first pin member 133, pivotal latch 127*a* prevents substrate 112 bottom sheet 116 from separating at slit 120*d*. When bottom sheet 116 is prevented from separating at slit 120*d*, top sheet 114 cannot fold at fold line 132 opposite slit 120*d*. In this way latch 127*a* prevents substrate 112 of advertising panel 110 from folding in response to pivotal latch 127*a* being engaged to first pin member 133.

FIG. 18 shows a top view of substrate 112 of FIG. 17 with pivotal latches 127*a* and 127*b*. FIG. 19 is an expanded view of section 167 of FIG. 18. Section 167 is a close up of pivotal latch 127*b* provided with rear flange portion 129 pivotably mounted on second pin member 131 and front hook portion 135 extending from rear flange portion 129 to selectively engage first pin member 133 on bottom sheet 116. Pivotal latch 127*b* is provided on bottom sheet 116 only. In this embodiment, pivotal latch 127*b* is provided on bottom sheet only so that pivotal latch 127*b* does not cover image 130 on top sheet 114. Substrate 112 is prevented from folding along fold line 132*e* in response to pivotable latch 127*b* engaging first pin member 133. In this embodiment, first and second pin members 133 and 131 extend through both bottom sheet 116 and top sheet 114, but the invention is not limited in this aspect. In some embodiments, first pin member 133 is coupled to bottom sheet 116 only. In some embodiments, second pin member 131 is coupled to bottom sheet 116 only. Pivotal latch 127*b* according to the invention is coupled to substrate 112 such that pivotal latch 127*b* is adjacent bottom sheet 116 only.

Pivotal latch 127 is used to prevent substrate 112 from folding along fold lines 132 when advertising panel 110 is in use. It is desirable to prevent substrate 112 from folding along fold lines 132 when substrate 112 is being used for advertising, such as when it is used in vehicle 140 to be viewed. Image 130 is easier to view and read when substrate 112 is flat. Pivotal latch 127 can be engaged with first pin member 133 whenever it is desirable to keep substrate 112 from folding at fold line 132. When it is desired to fold substrate 112, such as for storage or moving of advertising panel 110, pivotal latch 127 is disengaged from first pin member 133 allowing substrate 112 to fold along fold lines 132 for storage.

Figure 21:
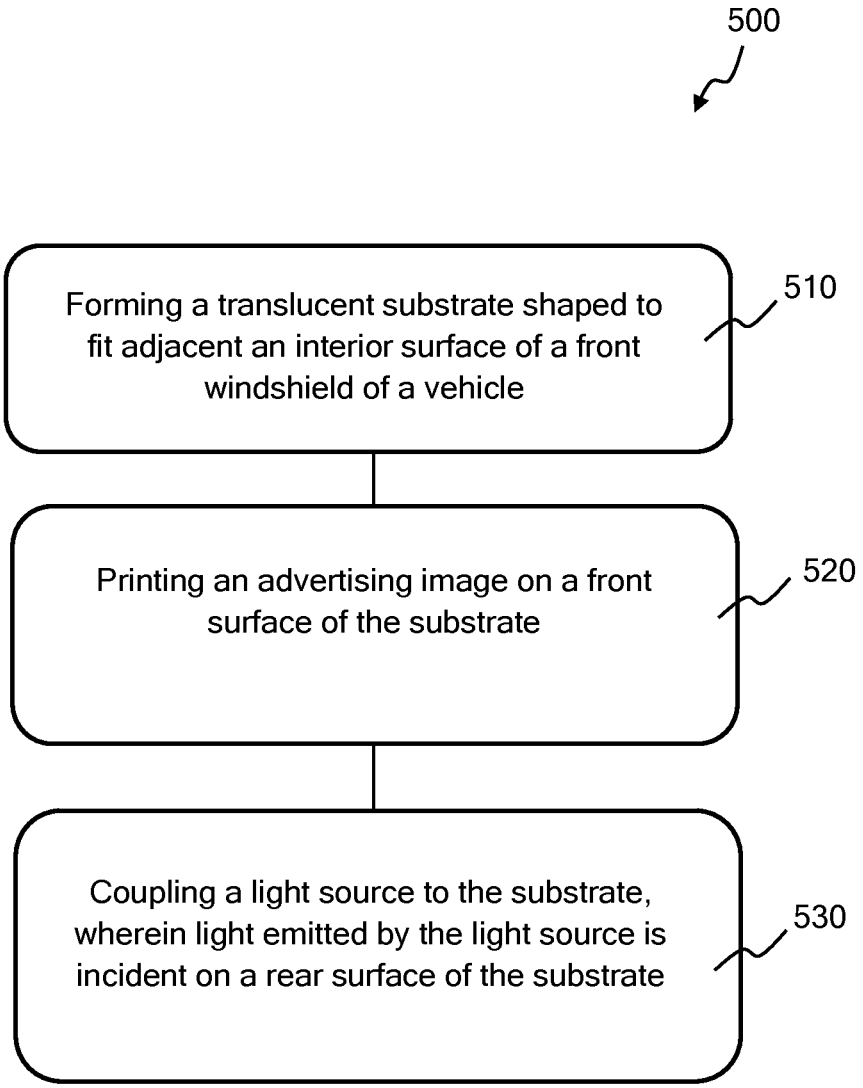
FIG. 21 illustrates method 500 of forming an advertising panel according to the invention.

FIG. 21 illustrates method 500 of forming an advertising panel. Method 500 includes step 510 of forming a translucent substrate shaped to fit adjacent an interior surface of a front windshield of a vehicle. Method 500 also includes step 520 of printing an advertising image on a front surface of the substrate. In some embodiments, the advertising image is translucent. Method 500 also includes step 530 of coupling a light source to the substrate, where light emitted by the light source is incident on a rear surface of the substrate.

In some embodiments, the substrate includes a top sheet, a bottom sheet having a slit, and a plurality of ribs coupling the top sheet to the bottom sheet in a spaced apart relationship. In some embodiments, method 500 includes slicing the substrate through the bottom sheet from a first edge of the substrate to a second edge of the substrate, leaving the top sheet intact.

Method 500 according to the invention can include many other steps. In some embodiments, method 500 includes the step of obtaining an advertising image. In some embodiments, method 500 includes the step of determining a position of a fold line in the top sheet relative to the advertising image. In some embodiments, method 500 includes the step of placing the slit in the bottom image opposite the position of the fold line in the top sheet relative to the advertising image.

In some embodiments of method 500, the substrate is formed of polyproplylene copolymer. In some embodiments, the top sheet is formed of aluminum. In some embodiments, the slice is placed between two adjacent ribs. In some embodiments, the ribs are parallel to each other. In some embodiments, slicing the substrate through the bottom sheet includes slicing the substrate through the bottom sheet and the ribs, leaving the top sheet intact. In some embodiments, the slit separates the bottom sheet and the ribs. In some embodiments, the slice results in a fold line being formed in the top sheet opposing the slice, wherein the substrate folds along the fold line.

A method of advertising a business according to the invention is disclosed which includes creating an advertising image for the business and printing the advertising image on a substrate, where the substrate comprises a top sheet, a bottom sheet, and a plurality of ribs coupling the top sheet to the bottom sheet in a spaced apart relationship. The method of advertising a business also includes slicing the substrate from a first edge of the substrate to a second edge of the substrate to form a fold line in the substrate opposing the slice, wherein the substrate folds along the fold line. The method of advertising a business also includes distributing the substrate for display.

In some embodiments, the substrate is translucent. In some embodiments the method of advertising a business includes illuminating a rear surface of the substrate with a light source. In some embodiments the method of advertising a business includes determining a predetermined position of a fold line relative to the advertising image, and placing the slice in the substrate opposite the predetermined position of the fold line relative to the advertising image. In some embodiments, the method of advertising includes shaping the substrate prior to printing. In some embodiments, the method of advertising a business includes shaping the substrate after printing.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. For example, embodiments of advertising panel 110 can be used to present educational materials, or can be used as toys for children.

The invention claimed is:

1. An advertising system comprising:
- a front windshield of a vehicle;
- a substrate, wherein the substrate is translucent, and wherein the substrate comprises:
  - a top sheet;
  - a bottom sheet;
  - and
  - a plurality of ribs coupling the top sheet to the bottom sheet in a spaced apart relationship;
- a slit in the bottom sheet, wherein the slit runs from a first edge of the substrate to a second edge of the substrate, and wherein the bottom sheet is separated along the slit;
- an image printed on the top sheet, wherein the top sheet is positioned towards the front windshield and the bottom sheet is positioned away from the front windshield; and
- a light source, wherein the light source illuminates the bottom sheet and wherein the light source is coupled to a sun visor of the vehicle.

2. The advertising system of claim 1, further comprising a fold line in the top sheet opposing the slit, wherein the substrate folds along the fold line.

3. The advertising system of claim 1, further comprising a coupling device, wherein the coupling device couples the top sheet to an inner surface of the front windshield.

4. The advertising system of claim 1, wherein the image printed on the substrate is translucent.

5. The advertising system of claim 1, wherein the slit is placed in a predetermined position relative to the image.

6. An advertising system comprising:
- a front windshield of a vehicle;
- an image printed on a flat substrate, wherein the substrate is shaped to fit adjacent an interior surface of the front windshield of the vehicle; and
- a light source adjacent a rear surface of the substrate, wherein light from the light source is transmitted through the substrate and the image and wherein the light source is coupled to a sun visor of the vehicle;
- wherein the substrate is formed of corrugated plastic comprising:
  - a top sheet
  - a bottom sheet
  - a plurality of ribs coupling the top sheet to the bottom sheet and
  - a slit running from a first edge of the substrate to a second edge of the substrate, wherein the bottom sheet and the ribs are separated along the slit, and wherein the top sheet is intact along the slit.

7. The advertising system of claim 6, further comprising a fold line in the top sheet opposing the slit, wherein the substrate folds long the fold line.

8. The advertising system of claim 6, further comprising a coupling device mechanically coupled to the substrate, wherein the coupling device couples the substrate to the front windshield of the vehicle.

9. A method of forming an advertising system comprising:
- forming a translucent substrate shaped to fit adjacent an interior surface of a front windshield of a vehicle;
- printing an advertising image on a front surface of the substrate;
- placing the substrate in the front windshield of the vehicle; and
- coupling a light source to a sun visor of the vehicle, wherein light emitted by the light source is incident on a rear surface of the substrate.

10. The method of forming an advertising system of claim 9, wherein the substrate comprises:
- a top sheet;
- a bottom sheet; and
- a plurality of ribs coupling the top sheet to the bottom sheet in a spaced apart relationship.

11. The method of forming an advertising system of claim 10, further comprising slicing the substrate through the bottom sheet from a first edge of the substrate to a second edge of the substrate, leaving the top sheet intact.

12. The method of forming an advertising system of claim 10, further comprising placing a slit in the substrate between two adjacent ribs.

13. The method of forming an advertising system of claim 12, further comprising:
- obtaining an advertising image; and
- determining a position of a fold line in the top sheet relative to the image.

14. The method of forming an advertising system of claim 13, wherein placing a slit in the substrate comprises placing a slit in the bottom sheet opposite the predetermined position of the fold line in the top sheet relative to the image.

* * * * *

UNITED STATES PATENT AND TRADEMARK OFFICE

CERTIFICATE OF CORRECTION

PATENT NO. : 9,390,636 B2
APPLICATION NO. : 14/516997
DATED : July 12, 2016
INVENTOR(S) : Alan Siegel It is certified that error appears in the above-identified patent and that said Letters Patent is hereby corrected as shown below:

In the claims
In claim 7, Column 12, Line 29, the word "long" should read "along."

Signed and Sealed this
Twenty-third Day of August, 2016

Michelle K. Lee

Michelle K. Lee
*Director of the United States Patent and Trademark Office*